United States Patent [19]

Taylor et al.

[11] 4,045,046

[45] Aug. 30, 1977

[54] SKATEBOARD WHEEL ASSEMBLY

[76] Inventors: Gary Burton Taylor, 565 W. 39th St.; Roland C. Eberhardt, 564 W. 39th St., both of San Pedro, Calif. 90731

[21] Appl. No.: 668,717

[22] Filed: Mar. 22, 1976

[51] Int. Cl.[2] ..... B62B 7/00

[52] U.S. Cl. ..... 280/87.04 A; 152/209 D; 280/11.27; 301/5.7

[58] Field of Search ..... 280/87.04 A, 87.04 R, 280/87.01, 11.27, 11.28, 11.19; 301/5.3, 5.7; 152/323, 209 R, 209 D

[56] References Cited

U.S. PATENT DOCUMENTS

| | | | |
|---|---|---|---|
| 880,921 | 3/1908 | Rosenberg | 152/323 X |
| 2,252,132 | 8/1941 | Mazveskas et al. | 301/5.7 X |
| 3,235,282 | 2/1966 | Bostick | 280/87.04 A |

FOREIGN PATENT DOCUMENTS

| | | | |
|---|---|---|---|
| 586,856 | 10/1933 | Germany | 301/5.7 |

*Primary Examiner*—Joseph F. Peters, Jr.
*Assistant Examiner*—John A. Pekar

[57] ABSTRACT

A heat dissipating skateboard wheel assembly on which an elongate cylindrical tire formed from an elastomeric material is so supported that when the tire is subjected to axially directed forces of substantial magnitude, the end portions of the tire will not tend to cold flow, but will instead temporarily deform into circular confined spaces defined on the assembly. The external surface of the tire preferably has circumferentially and axially spaced grooves extending thereinto, with the grooves cooperating to define a number of independently deformable islands therebetween. The islands, as they sequentially roll into pressure contact with a flat supporting surface deform three-dimensionally due to the combined weight of the skateboard and user to which they are subjected. The islands, as they so deform, are forced into maximum surface frictional contact with the supporting surface, and the skateboard is accordingly less inclined to slip laterally when the user of the skateboard is negotiating a sharp curve. Substantially the entire interior surface of the tire is maintained in a true cylindrical configuration when the assembly is in use, and accordingly the outer end portion of the tire cannot deform to a distinctive non-circular transverse cross section as occurs when present-day skateboard wheel assemblies are used. Due to the major portion of the present skateboard wheel assembly invention being formed from metal, the heat arising from friction during the use of the invention is transferred to the metal portion where it radiates to the ambient atmosphere rather than being transferred to the elastomeric tire that forms a part of the invention.

5 Claims, 7 Drawing Figures

A

B
10
14
18
22
16a
14a
12
16b
14b
16
20
D
48
74
72
C
40
38
56
54
50
50a
52
J
78
76
24

D-1
66
E
F

C
60a
E
66a
62
56
54
58a
62
40a
58
38
60
40b
F
46a
64
26
66b
46
42
50b
24
48b
78
68
50
36
J
10
72
D
76
74
76
16
50a
14
48a
60a
E
42
68
E
66b
44
52
32
28
30
J-1
62
F
66b
34
F
66a
E
66a
D
D

5

SKATEBOARD WHEEL ASSEMBLY

BACKGROUND OF THE INVENTION

1. Field of the Invention

Skateboard wheel assembly.

2. Description of the Prior Art

A majority of the present-day skateboard wheels in use are formed from cylindrical bodies of a polymerized resin that have bearings embedded therein, and these bearings being rotatably mounted on stubs that project outwardly from trucks that are secured to the underside of the skateboard. Such prior art skateboard wheel assemblies have a number of operational disadvantages. When the bearings in the prior art skateboard wheels become damaged or worn, the bearings cannot be replaced, and as a result the whole wheel assembly must be discarded. Furthermore, due to the construction of the prior art skateboard wheel assemblies, there is a tendency for the wheels of the assemblies to overheat, due to the fact that the bearings are embedded in a polymerized resin that is a poor transfer agent for heat. Heat arising in the bearing is accordingly transferred to the polymerized resin wheels, rather than being dissipated to the ambient atmosphere, and this intermittent heating of the polymerized resin causes the rapid disintegration thereof.

A major object of the present invention is to provide a skateboard wheel assembly that will elliminate a number of the operational disadvantages of prior art devices of this nature.

Another object of the invention is to provide a skateboard wheel assembly in which a major portion thereof is defined by metal, and heat arising from friction during the use of the assembly being transferred to the metal portion and radiating therefrom to the ambient atmosphere, rather than being transferred to the resilient tire that forms a part of the assembly.

Yet another object of the invention is to supply a skateboard wheel assembly in which the various components defining the same may be separated from one another and a defective component replaced when such is necessary.

A still further object of the invention is to supply a skateboard wheel assembly that includes a cylindrical resilient tire that is maintained in a fixed position on the assembly, and will have little or no tendency to cold flow when the tire is subjected to axially directed forces of substantial magnitude.

Another object of the invention is to supply a skateboard wheel assembly that includes a cylindrical resilient tire that is easily replaced when it has become worn, and as a consequence the metal portion of the wheel assembly may be used for a prolonged period of time, with only the tire being replaced periodically as such is required.

SUMMARY OF THE INVENTION

The skateboard wheel assemblies of the present invention are used in combination with a skateboard having a pair of longitudinally spaced trucks that extend downwardly from the lower surface of the board, with each of the trucks including a center body that has two transversely aligned stub axles projecting outwardly from opposite sides thereof. Each of the stub axles includes first and second aligned cylindrical portions, with each of the portions having first and second ends.

The first end of the first axle portion is disposed adjacent a first shoulder defined on the body of the truck, and the second axle portion being of smaller diameter of the first axle portions and having threads on the exterior surface thereof. The second ends of the first and second axis portions are in abutting contact and cooperate to define a second body shoulder.

Each of the skateboard wheel assemblies includes a rigid cylindrical wheel member formed from a metallic material having a substantial heat-conducting quality. Each member has first and second oppositely disposed ends from which first and second circular cavities extend inwardly toward one another. A centrally disposed bore is formed in the wheel member and extends between the first and second cavities. The bore is of greater diameter than the diameter of the first axle portion. a circumferentially extending rib projects outwardly from the wheel member adjacent the first end thereof, with the rib having a first inwardly disposed ring-shaped face that has an outer section and an inner section. The outer section is substantially parallel to the first ends of the wheel member, and the inner section is angularly disposed to the outer section. A cylindrical shell of substantially the same external diameter as the wheel member projects from the second end of the latter and is axially aligned with the wheel member. The shell has an interior cylindrical surface and an exterior cylindrical surface and the exterior surface of an outwardly disposed end portion thereof having a first circumferential extending groove formed therein.

First and second ball bearing assemblies are disposed in the first and second cavities, with each of the ball bearing assemblies including inner and outer races. The inner races have the first portion of said stub shaft extending therethrough. The inner race of the first ball bearing assembly is in abutting contact with the first shoulder of the body.

A nut is in engagement with the threads on the second axle portion, and this nut being in abutting contact with the inner race of the second ball bearing assembly. An elongate cylindrical tire is provided that is formed from an elastomeric material such as polyurethane, with the tire having concentric inner and outer cylindrical surfaces and first and second end surfaces. First and second circular recesses extend inwardly towards one another form the inner portions of the first and second end surfaces. The first and second recesses each are partially defined by inner walls parallel to the first and end surfaces of the wheel member. The inner cylindrical surface of the tire is of such diameter as to snugly and slidably engage the exterior surface of the wheel member and shell. The wall that partially defines the first recess is in abutting contact with the outer section of the rib, and the wall of the first recess and inner section of the rib cooperate to define a first circumferentially extending confined space therebetween.

A retaining ring is provided that is removably mounted on the outwardly disposed end portion of the shell and inwardly from the groove therein. The retaining ring has an inwardly disposed surface defined by a first ring-shaped section and a second inwardly disposed ring-shaped section that is angularly disposed relative to the first ring-shaped section of the retaining ring. The first ring-shaped section of the retaining ring is in abutting contact with the wall of the second recess, and the second ring-shaped section of the retaining ring cooperate with the wall of the second recess to define a second circumferentially extending confined space. A resilient ring engages the groove to hold the retaining ring in abutting contact with the wall of the second recess to maintain the tire in a fixed position on the wheel member and shell. When the tire is subjected to an axially directed force of substantial magnitude as occurs when the skateboard is directed through a curved path, the end portions of the tire may temporarily deform into either the first or second confined spaces, rather than the resilient material defining the tire cold flowing outwardly over the rib or retaining ring to be permanently deformed and with subsequent damage to the tire as such cold flowing intermittently occurs.

The components above-described may be individually separated from one another, and as a result when one of the components wears to the extent that it must be replaced, it may be easily separated from the assembly and a new component substituted in its stead. The major portion of the wheel assembly is formed from a heat-conducting metallic material, and this material serving as a heat sink to which heat flows when the invention is in use, rather than the heat generated by friction being transferred to the tire to cause a gradual deterioration of the latter.

DESCRIPTION OF THE PREFERRED EMBODIMENT

Figures 1, 2, 3, 4, 5, 6, 7:
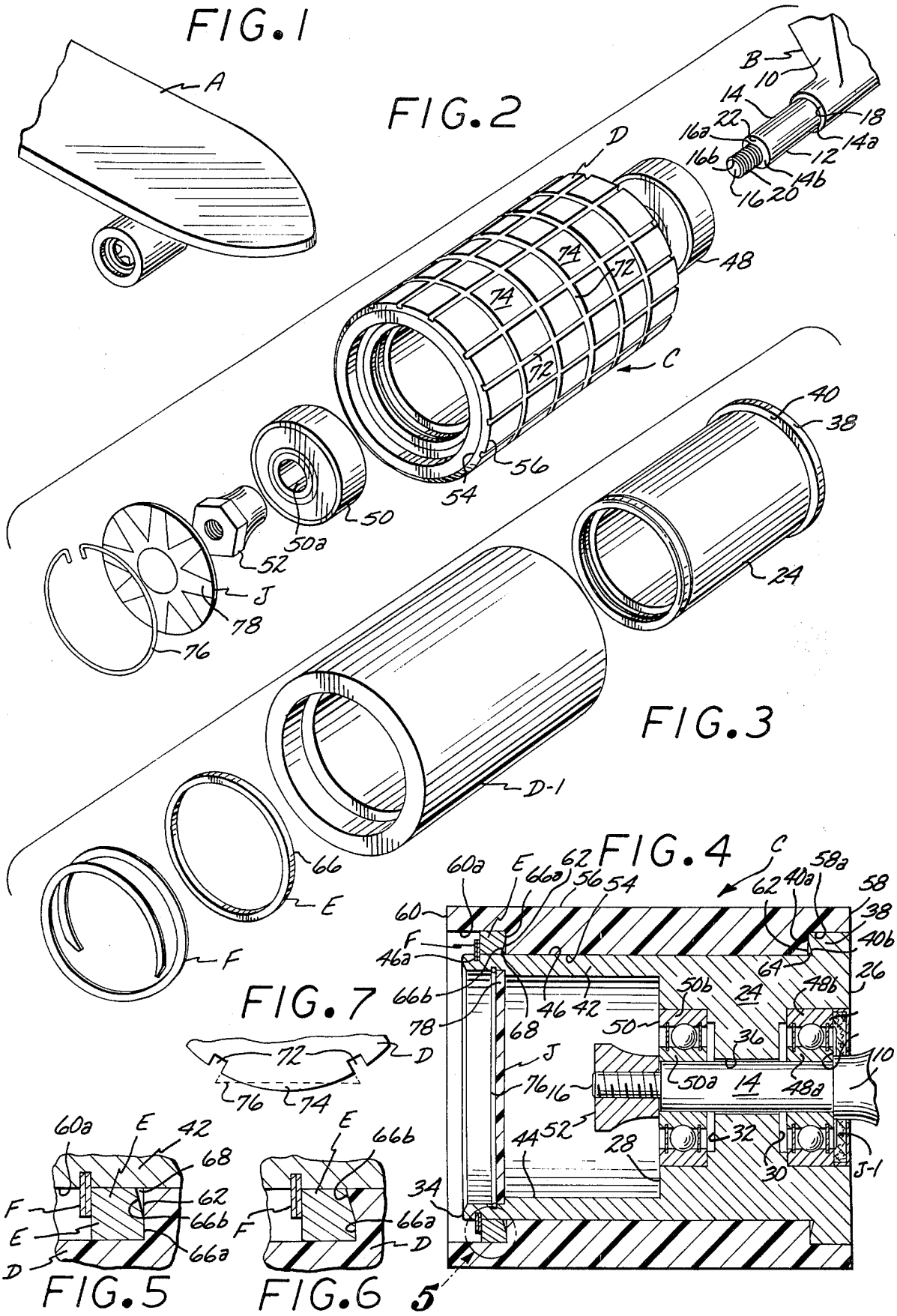
FIG. 1 is a perspective view of a skateboard illustrating one of the four wheel assemblies of the present invention.
FIG. 2 is an exploded perspective view of the skateboard wheel assembly of the present invention and illustrating a first form of tire that may be used therewith.
FIG. 3 is an exploded perspective view of a second form of tire and wheel support therefor that may be used in the present invention with both the first and second forms of tires requiring the retaining ring and resilient circular clip shown in FIG. 3.
FIG. 4 is a longitudinal cross-sectional view of the skateboard wheel assembly.
FIG. 5 is a fragmentary transverse cross-sectional view taken within the circle in phantom line in FIG. 4 identified by the FIG. 5, and illustrating the retaining ring and portion of the tire adjacent thereto when the tire is not subjected to an axially directed force of substantial magnitude.
FIG. 6 is the same view as shown in FIG. 5, but with the tire being subjected to an axial directed force of substantial magnitude.
FIG. 7 is a diagrammatic view of a portion of the tire as shown in FIG. 2 and illustrating how one of the resilient islands defined thereof three-dimensionally deforms when in pressure contact with a supporting surface.

In FIG. 1 a portion of a conventional stakeboard A is shown that has a pair of longitudinally spaced trucks B, also of conventional design secured thereto. Each of the trucks B, as may be seen in FIG. 2, includes a central body 10 that has two transversely aligned stub shafts 12 projecting outwardly from opposite sides thereof. In FIG. 2, only one of the stub shafts 12 is shown. Each of the stub shafts 12 includes a first cylindrical portion 14 and a second cylindrical portion 16 that is axially aligned with the first portion. The first cylindrical portion 14 has first and second ends **14*a* and 14*b*. The second shaft portion 16 has first and second ends 16*a* and 16*b*. The first end 14*a* of the first cylindrical portion 14 is adjacent a first shoulder 18 defined on the body 10. The second cylindrical portion 16 is of smaller diameter than the first cylindrical portion 14, and the first cylindrical portion having threads 20 on the exterior surface thereof. The second ends 14*b* and 16*b* of the first and second axle portion 14 and 16 are in abutting contact and cooperate to define a second circular body shoulder 22 as may best be seen in FIG. 2**.

The wheel assembly C of the present invention, as may be seen in FIG. 2, includes a rigid cylindrical wheel member 24 formed from a metallic material that has substantial heat-conducting qualities, with the member having first and second oppositely disposed ends 26 and 28 from which first and second circular cavities 30 and 32 extend inwardly towards one another. The first and second cavities 30 and 32 are connected by a bore 36 that is centrally disposed relative to the wheel member 24. The bore 36 is of greater diameter than the diameter of the first axle portions 14 that extend therethrough, as shown in FIG. 4. The circumferentially extending rib 38 projects outwardly from the wheel member 24 adjacent the first end 26 thereof. The rib 38 has a first inwardly disposed ring-shaped face 40, which face has an outer circumferential section **40*a* and an inner circumferential section 40*b*. The outer section 40*a* is substantially parallel to the first end 26 of the wheel member 24 and the inner section 40*b* is angularly disposed relative to the outer section, as may be seen in FIG. 4. A cylindrical shell 42 of substantially the same external diameter as the wheel member 24 projects from the second end 28 of the wheel member, as shown in FIG. 4. The shell 42 has an interior cylindrical surface 44 and an external cylindrical surface 46. The external surface 46 has a first circumferentially extending groove 46*a* therein which groove is adjacently located to end 34 of the shell 42**.

First and second ball bearing assemblies 48 and 50 are provided that are disposed in the first and second cavities 30 and 32 as shown in FIG. 4. The first ball bearing assembly 48 includes inner and outer races **48*a* and 48*b*, and the second ball bearing assembly 50 likewise includes first and second races 50*a* and 50*b*. The inner races 48*a* and 50*a* have the first axle portion 14 extending therethrough as shown in FIG. 4. A nut 52 is in engagement with the threads 20 on the second axle portion 16, with the nut being in abutting contact with the inner race 50*a* of the second ball bearing assembly 50**.

An elongate cylindrical tire D is provided that is formed from an elastomeric material such as polyurethane or the like, with the tire having concentric inner and outer cylindrical surfaces 54 and 56 and first and second end surfaces 58 and 60. First and second circular recesses **58*a* and 60*a* extend inwardly from the first and second end surfaces 58 and 60. The first and second recesses 58*1* and 60*a* are each partially defined by an inner wall 62, which inner walls are parallel to first and second end surfaces 26 and 28 of the wheel member 24. The inner cylindrical surface 54 is of such diameter as to snugly and slidably engage the exterior surfaces of the wheel member 24 and shell 42. The wall 62 of the first recess 58*a* is in abutting contact with the outer section 40*a* of the rib 38. The wall 62 and the inner section 40*b* cooperate to define a circumferentially extending confined space 64**.

A retaining ring E is provided that is removably mounted on the outwardly disposed end portion of the shell 42 and situated inwardly from the groove **46*a*. The retaining ring E has an inwardly disposed surface 66, which surface is defined by a first outer ring-shaped section 66***a* and a second inwardly disposed ring-shaped section 66*b*. The section 66*b* is angularly disposed relative to the first ring-shaped section 66*a*. The first ring-shaped section 66*a*, as may be seen in FIGS. 5 and 6 is at all times in abutting contact with the wall 62 and second recess 60*a*. The retaining ring E also includes a second inwardly disposed ring-shaped section 66*b* that is angularly disposed relative to the first ring-shaped section 66*a*, with the second ring-shaped section 66*b* cooperating with the wall 62 of recess 60*a* to define a second circumferentially extending confined space 68. A resilient ring F removably engages the groove 46*a*, with the ring being in abutting contact with the retaining ring E, and the ribs 38 and retaining ring as may be seen in FIG. 4 serving to maintain the tire D in a fixed position on the wheel member 24 and shell 42. When the tire D is subjected to a substantial axially directed force, such as when the skateboard A is directed through a sharp curve, the tire D will temporarily deform into either the first confined space 64 or second confined space 68. Due to the material defining the tire D being capable of temporarily deforming into either the first or second confined space 64 or 68, the tendency of the material defining the tire to cold flow outwardly past the rib 68 or retaining ring E is substantially eliminated. The tire D, as may best be seen in FIG. 2, preferably has a number of circumferentially spaced and axially spaced grooves 70 formed therein that subdivide the exterior surface 56 of the tire into a number of spaced islands 74 that are independently deformable when the islands 74 are subjected to substantial pressure as occurs when they come into pressure contact with a supporting surface (not shown), the islands deform three-dimensionally. In FIG. 7, one of the islands 74 is shown in solid line, but with the configuration of the island being shown in phantom line when it is subjected to substantial pressure due to the weight of the skateboard A and the user thereof (not shown). In FIG. 7, it will be seen that as each of the islands 74 deform, the island has a greater surface 76 brought into contact with the supporting surface, and this additional surface increasing the frictional resistance between the island and supporting surface to minimize the tendency of the tire D to skid laterally from its path of movement when the user of the skateboard A makes a sharp turn. The material defining the tire D should be sufficiently soft, and the tire sufficiently thick, that when a user inadvertently runs over a pebble or the like on the supporting surface, the pebble will momentarily deform a portion of the tire D inwardly. The material is sufficiently resilient that after the pebble is momentarily embedded in the tire D, the tire will tend to return to its normal configuration and is so doing eject the pebble from the tire, and without the user of the skateboard A being thrown from the board A by it suddenly stopping due to one of the tires D momentarily contacting a small solid object such as a pebble or the like. A tire D-1 is shown in FIG. 3 that is of the same structure as the tire D, but having a smooth external surface 56. The tire D-1 is held on the assembly in the same manner as the tire D, but is not efficient as the latter. Should it be desired, a decorative plate J as shown in FIG. 2 may be removably disposed within the interior of the shell 42 to abut against a circular body shoulder 76 formed in the outer portion of the shell to prevent entry of dust or other foreign material into the ball bearing assembly J. A plate J-1 may be removably mounted on the opposite end of the wheel member to prevent entry of dust into the first bearing assembly 48. The plate J may have simulated spokes 78 defined thereon. The plate J is removably held within the shell by a spring clip 76 that engages a circumferentially extending groove 78 formed in the interior of the shell 42 adjacent the ends 34 of the latter.

When the wheel assembly above-described is in use, heat generated by friction of the assembly about the second axle portion 14, flows into the metallic wheel member 24 and radiates from the wheel member and shell 42 to the ambient atmosphere, rather than the heat being transferred to the tire D or D-1 as the case may be. Minimizing the heating of the tire D or D-1 is highly desirable, as such intermittent heating of the tire gradually results in the deterioration of the resilient material defining the same. Likewise the minimizing of cold flow of the material defining the tire D or D-1 outwardly past the rib 38 or retaining ring E is highly undesirable, for such cold flow when it takes place is permanent, and there is a gradual deterioration of the tire D or D-1 as intermittent cold flow of the material defining the tire takes place. The confined spaces 64 and 68 not only eliminate the problem of cold flow, but also provide spaces into which the material defining the tire D may expand as such material is heated during use of the skateboard A. The ball bearing assemblies 48 and 50 are illustrated as being of the precision type, but open type ball bearing assemblies may be employed if desired. Although the wheel member 24 and shell 42 have been previously described as being formed from a metallic material having a good heat conducting quality, the material may also be one such as "Lexan" manufactured by the General Electric Company.

The use and operation of the invention has been described previously in detail and need not be repeated.

We claim:

1. In combination with a skateboard having a pair of longitudinally spaced trucks, each of said trucks including a center body that has two transversely aligned stub axles projecting outwardly from opposite sides thereof, each of said stub axles including first and second axially aligned cylindrical portions, said second axle portion of smaller diameter than said first axle portion and having threads on the exterior surface thereof, said first portion forming a first body shoulder with said body and a second body shoulder at the junction with said second portion, wherein the improvement comprises four wheel assemblies rotatably supported on said stub axles, each of said wheel assemblies including:

a. a rigid cylindrical wheel member formed from a metallic material having a substantial heat conducting quality, said member having first and second oppositely disposed ends from which first and second circular cavities extend inwardly towards one another, a centrally disposed bore in said wheel member that extends between said first and second cavities, said bore of greater diameter than the diameter of said first axle portion, a circumferentially extending rib projects outwardly from said wheel member adjacent said first end thereof, said rib having a first inwardly disposed ring-shaped face that has an outer circumferential section and an inner circumferential section, said outer circumferential section substantially parallel to said first end of said member, and said inner circumferential section angularly disposed relative to said outer circumferential section, a cylindrical shell of substantially the same external diameter as said wheel member projects from said second end of the latter and is axially aligned with said wheel member and formed integral therewith, said shell having an interior cylindrical surface and exterior cylindrical surface said exterior cylindrical surface of said shell on an outwardly disposed end portion thereof having a circumferential groove formed therein;

b. first and second ball bearing assemblies disposed in said first and second cavities, each of said ball bearing assemblies including inner and outer races, said inner races having said first portion of said stub axle extending therethrough, said inner race of said first ball bearing assembly in abutting contact with said first shoulder of said body;

c. a nut in engagement with said threads on said second axle portion, said nut in abutting contact with said inner race of said second ball bearing assembly;

d. an elongate cylindrical tire formed from an elastomeric material, said tire having concentric inner and outer cylindrical surfaces and first and second end surfaces, first and second circular recesses that extend inwardly towards one another from inner portions of said first and second end surfaces, said first and second recesses each partially defined by inner walls parallel to said first and second end surfaces, said inner cylindrical surface of such diameter as to snugly and slidably engage said exterior surfaces of said wheel member and shell, said wall of said first recess in abutting contact with said outer circumferential section of said rib, and said wall of said first recess and said inner circumferential section of said rib cooperating to define a first circumferentially extending confined space therebetween;

e. a retaining ring removably mounted on said outwardly disposed end portion of said shell inwardly from said groove, said retaining ring having an inwardly disposed surface defined by a first outer ring-shaped section and a second inwardly disposed ring-shaped section that is angularly disposed relative to said first ring-shaped section of said retaining ring, said first ring-shaped section of said retaining ring in abutting contact with said wall of said second recess, and said second ring-shaped section of said retaining ring cooperating with said wall of said second recess to define a second circumferentially extending confined space; and f. resilient means that engage said groove to hold said retaining ring in abutting contact with said wall of said second recess to maintain said tire in a fixed position on said wheel member and shell, and said tire when subjected to an axially directed force as said skateboard is directed through a curved path temporarily deforming into either said first or second confined spaces, rather than cold flowing outwardly over said rib or retaining ring.

2. A wheel assembly as defined in claim 1 in which said tire has a plurality of spaced grooves therein that define a plurality of three dimensionally deformable islands therebetween, with said islands sequentially deforming due to the weight of the user on said skateboard as they roll into pressure contact with a supporting surface, said islands when so deformed having an increased area in frictional rolling contact with said supporting surface.

3. A wheel assembly as defined in claim 1 in which said shell has a circumferentially extending body shoulder on the interior surface thereof adjacent said outer end, and said wheel assembly in addition including:

g. a decorative plate disposed within said shell and in abutting contact with said body shoulder on said interior surface; and h. a snap ring that engages a circumferential groove in said interior surface, said snap ring abutting against said plate to removably hold said plate against said body shoulder on said interior surface.

4. A wheel assembly as defined in claim 3 in which said plate has a central body portion from which a plurality of radially extending and circumferentially spaced simulated spokes extend.

5. A wheel assebly as defined in claim 1 which in addition includes:

f. means removably mounted on said wheel member for preventing the entry of foreign material from the exterior of said wheel assembly into said ball bearing means.

* * * * *